US005368287A

United States Patent [19]

Belec et al.

[11] Patent Number: 5,368,287

[45] Date of Patent: Nov. 29, 1994

[54] NINETY DEGREE TURN-UP APPARATUS

[75] Inventors: Eric A. Belec, Southbury; William D. Toth, Milford, both of Conn.

[73] Assignee: Pitney Bowes Inc., Stamford, Conn.

[21] Appl. No.: 152,802

[22] Filed: Nov. 15, 1993

[51] Int. Cl.[5] ..... B65H 29/00

[52] U.S. Cl. ..... 271/185

[58] Field of Search ..... 271/184, 185; 198/405, 198/411, 839

[56] References Cited

U.S. PATENT DOCUMENTS 2,841,394 7/1958 Stobb ..... 271/185
4,226,324 10/1980 Stocker .
4,705,157 11/1987 Bowles .
5,201,504 4/1993 Fallos et al. ..... 271/2

FOREIGN PATENT DOCUMENTS 675556 7/1952 United Kingdom ..... 198/405

*Primary Examiner*—David H. Bollinger
*Attorney, Agent, or Firm*—Charles R. Malandra, Jr.; Melvin J. Scolnick

[57] ABSTRACT

The present invention provides a device for turning flat articles, such as envelopes, from a horizontal orientation to a vertical orientation as the articles are transported along a path from an entrance location to an exit location. The device comprises a pair of entrance pulleys, each of the entrance pulleys having an offset crown and rotating on a stationary horizontal axis, and a pair of exit pulleys, each of the exit pulleys having a centerline crown. The entrance pulleys are located longitudinally and vertically apart from one another such that one of the entrance pulleys functions as lower entrance pulley and the other entrance pulley functions as an upper entrance pulley, with the upper entrance pulley being located downstream from the lower entrance pulley. The exit pulleys rotate on a stationary vertical axis. One of the exit pulleys is located downstream from an upstream one of the exit pulleys. The device further comprises first and second flexible, endless belts. The first belt is wrapped around the lower entrance pulley and the upstream exit pulley. The second belt is wrapped around the upper entrance pulley and the downstream exit pulley, wherein the first and second belts complete a 90 degree twist from the respective entrance pulley to the respective exit pulley such that the first and second belts each have a contiguous span for approximately the entire 90 degree twist against which a corresponding span of the other belt applies a normal force.

6 Claims, 5 Drawing Sheets

NINETY DEGREE TURN-UP APPARATUS

FIELD OF THE INVENTION

The invention disclosed herein relates generally to apparatus for handling envelopes, and more particularly, to apparatus for turning a envelope from horizontal position to a vertical position.

RELATED APPLICATIONS

The present application is related to copending U.S. application Ser. Nos. 08/152,791, 08/152,793, 08/152,790, and 08/152,787, all having a filing date of Nov. 15, 1993 and assigned to the assignee of the present invention.

BACKGROUND OF THE INVENTION

In most conventional inserting machines each mail piece is processed along a horizontal path after the insertion function has been completed. Such horizontal processing is typically necessary so that a postage meter can affix or print postage on the stuffed envelope comprising the mail piece. However, once postage has been applied to the envelope, the envelope is generally conveyed to a stacking device as the envelope leaves the inserting machine. In some cases, the envelope is conveyed to a horizontal stacking device from which an operator removes a stack of envelopes when the stack reaches a certain number of envelopes. The removed stack may then be manually placed in a mail tray that will be sent to the postal service. In this manner, the user can take advantage of lower postal rates which are provided to users that tray envelopes according to some predetermined criteria.

It is known to stack mail pieces on edge after being processed on an inserting machine. For example, an on-edge stacker is disclosed in U.S. Pat. No. 5,201,504. There are certain advantages in stacking the mailpieces on edge. In particular, the stacks of mailpieces can be stacked at higher densities before an operator needs to be involved. Typically, on-edge stacking can be processed at a higher speed and the stacks are more easily transferred to mail trays that can be used later during the processing of the mailpieces by the postal service. Before such on edge stacking devices can be used to process mailpieces output from a typical inserting machine, it is necessary to change the orientation of the mail pieces from horizontal to vertical.

An example of a device for turning articles such as envelopes 90 degrees as the articles move from an entrance location to an exit location is disclosed in U.S. Pat. No. 4,705,157. The device includes a pair of flexible endless belts each having a span contiguous to a corresponding span of the other. A pair of entrance and exit roller/pulleys have the flexible belts wrapped around them. The entrance roller/pulleys are opposed but offset such that the envelope begins to turn immediately upon being engaged by the pulleys and belts. Idler rollers, commonly referred to as steering rollers, assist in keeping the belts properly positioned on the entrance and exit roller/pulleys.

It an object of the present invention to provide a simple and reliable turn-up device that turns envelopes having a variety of thickness from a horizontal to a vertical orientation.

It is a further object of the present invention to provide a turn-up device that can be coupled to the output end of an inserting machine.

SUMMARY OF THE INVENTION

The present invention provides a simple, low cost, highly reliability method of turning articles with continuous motion from a top edge, registered, horizontal orientation to a bottom edge, registered, vertical orientation. The present invention is suitable for use in a great variety of applications, including finished envelopes output from an inserting machine. This device is especially important as an interface between traditional inserting equipment and "on-edge" mail stacking devices.

In accordance with the present invention an adjustable flat belt, 90 degree turn-up transport is laterally positioned to process any size mailpiece that is received from an inserter (or inserter finishing device) in a top edge registered horizontal orientation to be deposited in a vertical orientation with its bottom edge justified against a fixed surface. In the manner described below, the mailpiece is transported between dual belts at all times to maintain total paper handling control. This is an especially important process with respect to inserters with postage meters.

The present invention requires fewer parts than conventional turn-up devices because the present invention does not include steering rollers. Conventional turn-up devices have pulleys with centerline crowns and use steering rollers to keep the twisting belts on the pulley. It has been found that the need for steering rollers can be eliminated by using offset crowns on the horizontal entrance pulleys and maintaining all pulleys stationary. It has also been found that by offsetting both the entrance pulleys and the exit pulleys, the pulleys can be stationary.

It has been found that the present invention provides reliable 90 degree turn-up of flat articles which are being transported along a horizontal plane. The articles enter horizontally into a "soft" nip of a stationary pulley and an idler roller and the articles are sandwiched between the belts for the entire 90 degree twist, i.e. the belts are not offset during the twist as in other conventional turn-up devices. Further, the present invention has been found to be more reliable because it comprises fewer moving parts, i.e., it does not include steering rollers and moving pulleys found in conventional turn-up devices.

The present invention provides a device for turning flat articles, such as envelopes, from a horizontal orientation to a vertical orientation as the articles are transported along a path from an entrance location to an exit location. The device comprises a pair of entrance pulleys, each of the entrance pulleys having an offset crown and rotating on a stationary horizontal axis, and a pair of exit pulleys, each of the exit pulleys having a centerline crown. The entrance pulleys are located longitudinally and vertically apart from one another such that one of the entrance pulleys functions as lower entrance pulley and the other entrance pulley functions as an upper entrance pulley, with the upper entrance pulley being located downstream from the lower entrance pulley. The exit pulleys rotate on a stationary vertical axis. One of the exit pulleys is located downstream from an upstream one of the exit pulleys. The device further comprises first and second flexible, endless belts. The first belt is wrapped around the lower entrance pulley and the upstream exit pulley. The second belt is wrapped around the upper entrance pulley and the downstream exit pulley, wherein the first and second belts complete a 90 degree twist from the respective entrance pulley to the respective exit pulley such that the first and second belts each have a contiguous span for approximately the entire 90 degree twist against which a corresponding span of the other belt applies a normal force.

The device further comprises means for guiding flat articles that are transported by the belts through the ninety degree twist, wherein the guiding means comprises a contour wire guide shaped to guide a portion of the flat article that is extending beyond the grip of the first and second belts.

The device also includes a lower entrance roller adjacent the lower entrance pulley and rotating on the same horizontal axis as the lower pulley, and a plurality of idler rollers against the lower entrance roller and the lower idler pulley.

DESCRIPTION OF THE DRAWINGS

The above and other objects and advantages of the present invention will be apparent upon consideration of the following detailed description, taken in conjunction with accompanying drawings, in which like reference characters refer to like parts throughout, and in which.

DETAILED DESCRIPTION OF THE PRESENT INVENTION

Figure 1:
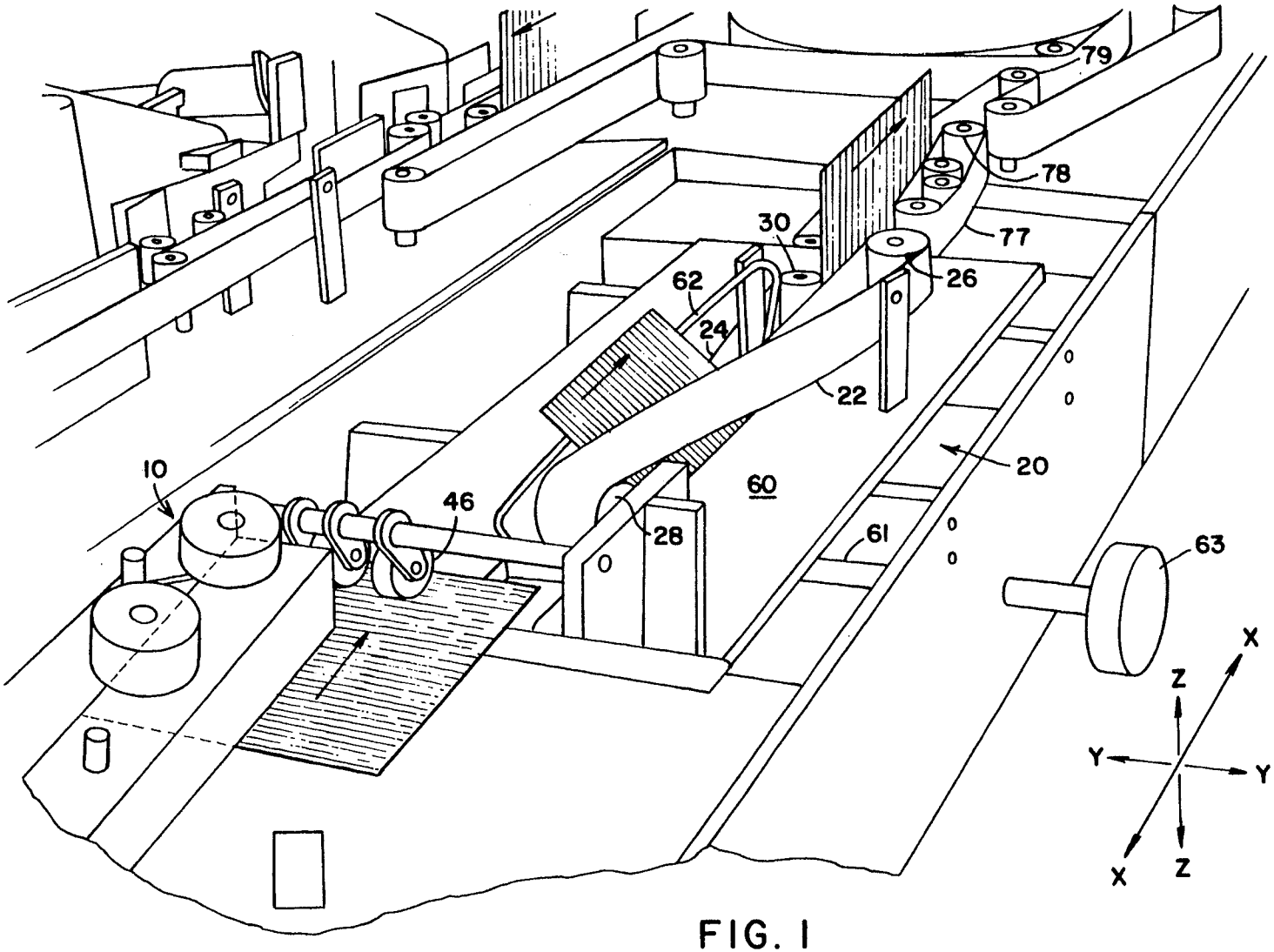
FIG. 1 is a perspective view from the entrance end of a turn-up device in accordance with the present invention.
Figure 2:
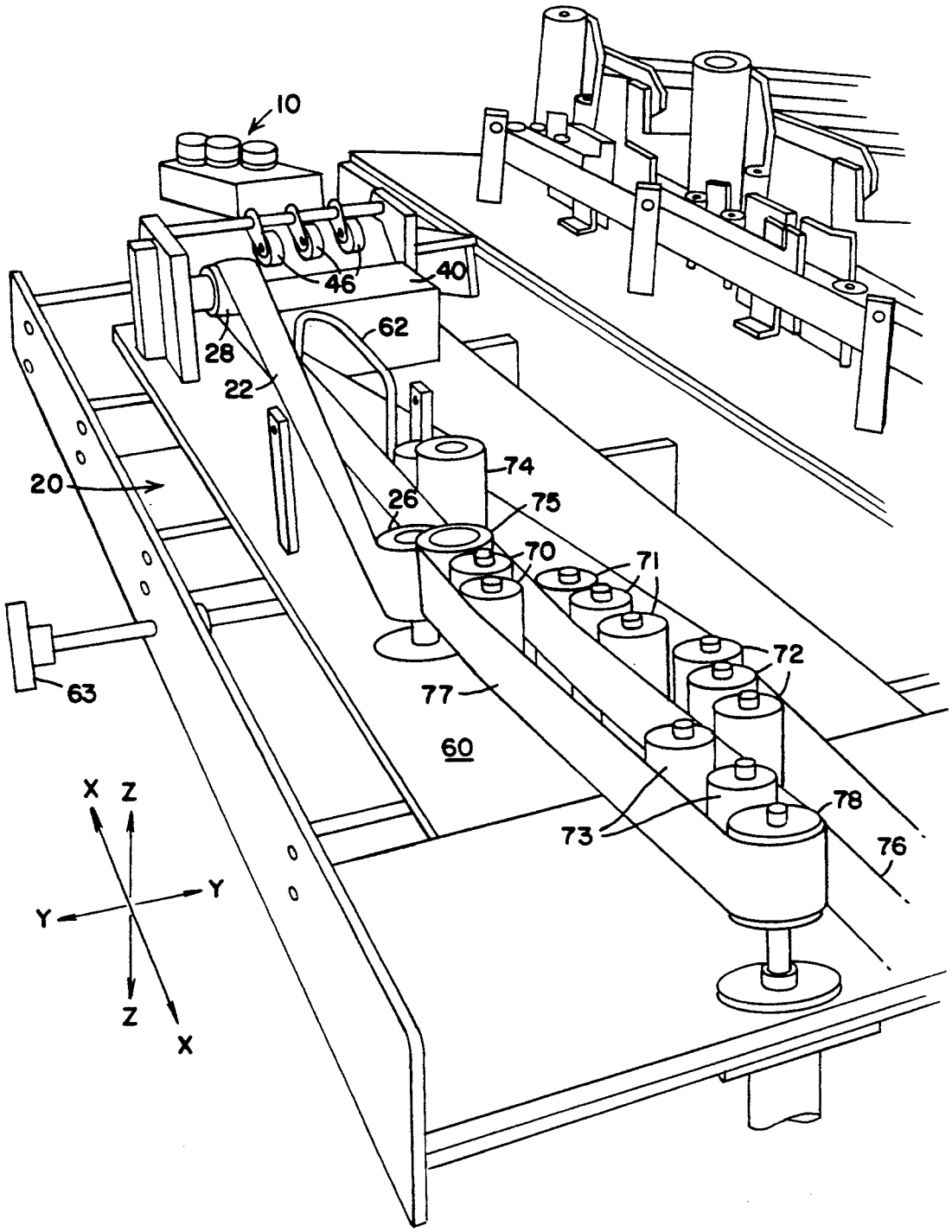
FIG. 2 is a perspective view from the exit end of the turn-up device of FIG. 1.
Figure 3:
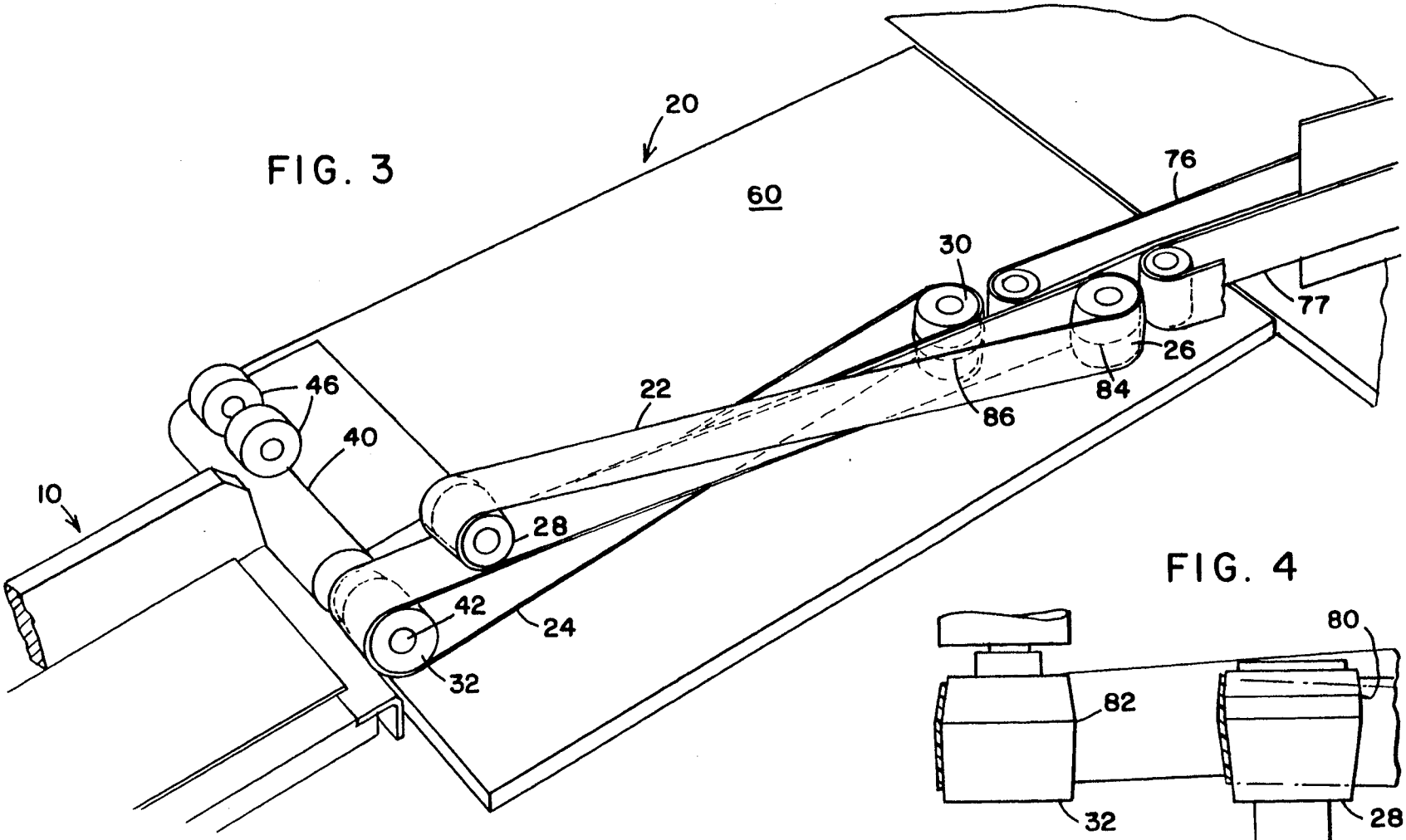
FIG. 3 is a schematic of the turn-up belt and pulley assembly of the device of FIG. 1.
Figure 4:
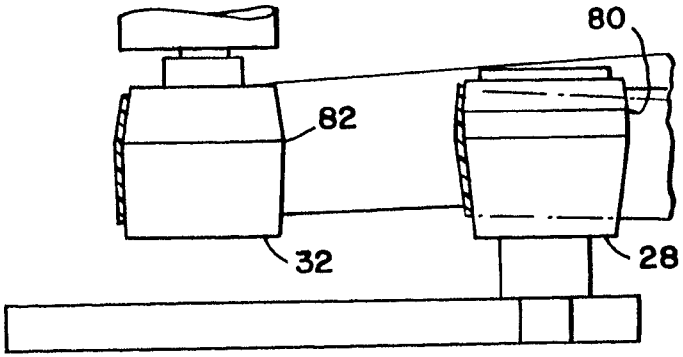
FIG. 4 is top view of the entry pulleys of the assembly of FIG. 3 showing the lower reach of each belt.
Figure 5:
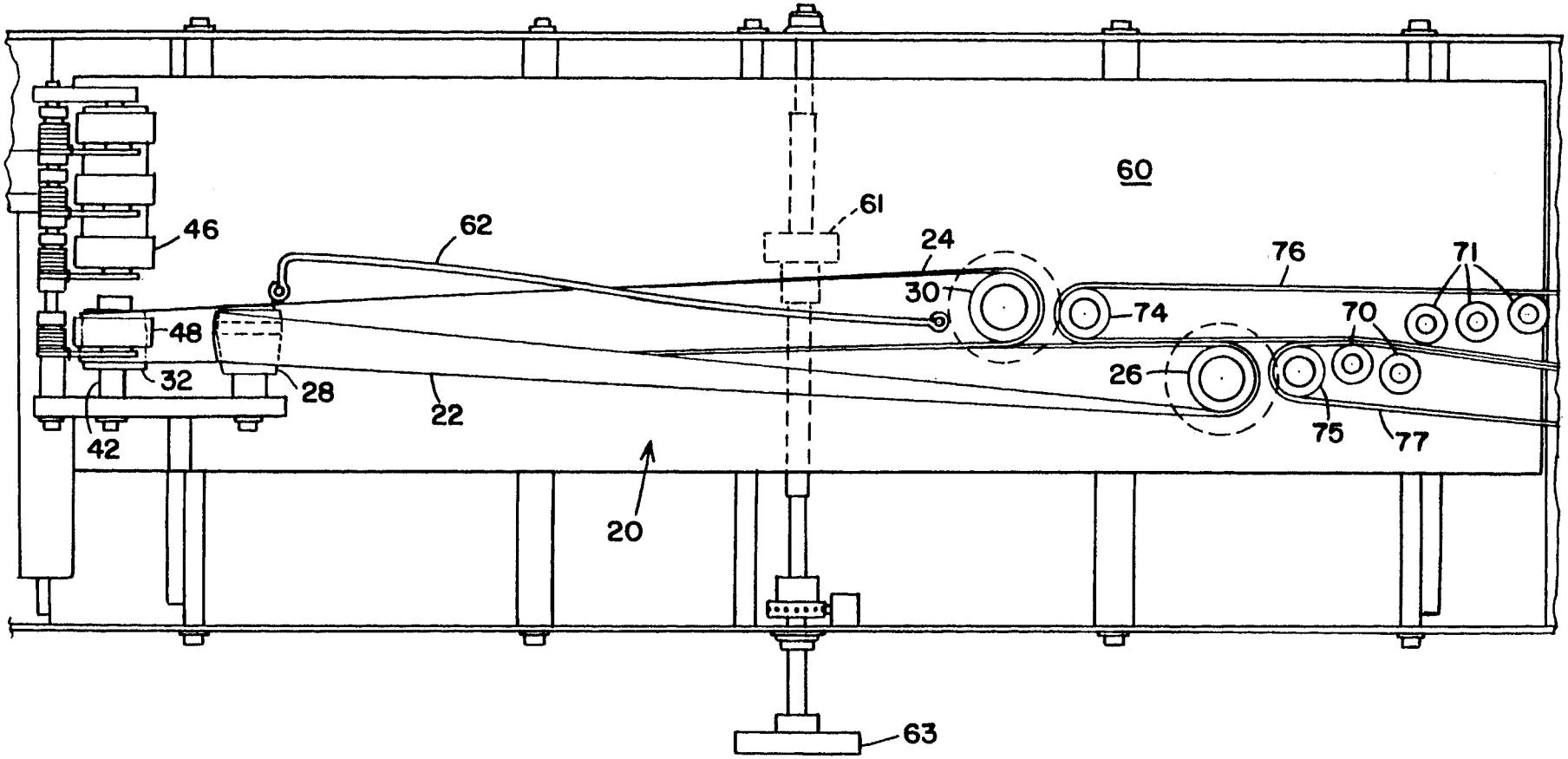
FIG. 5 is top view of the turn-up assembly of FIG. 3.
Figure 6:
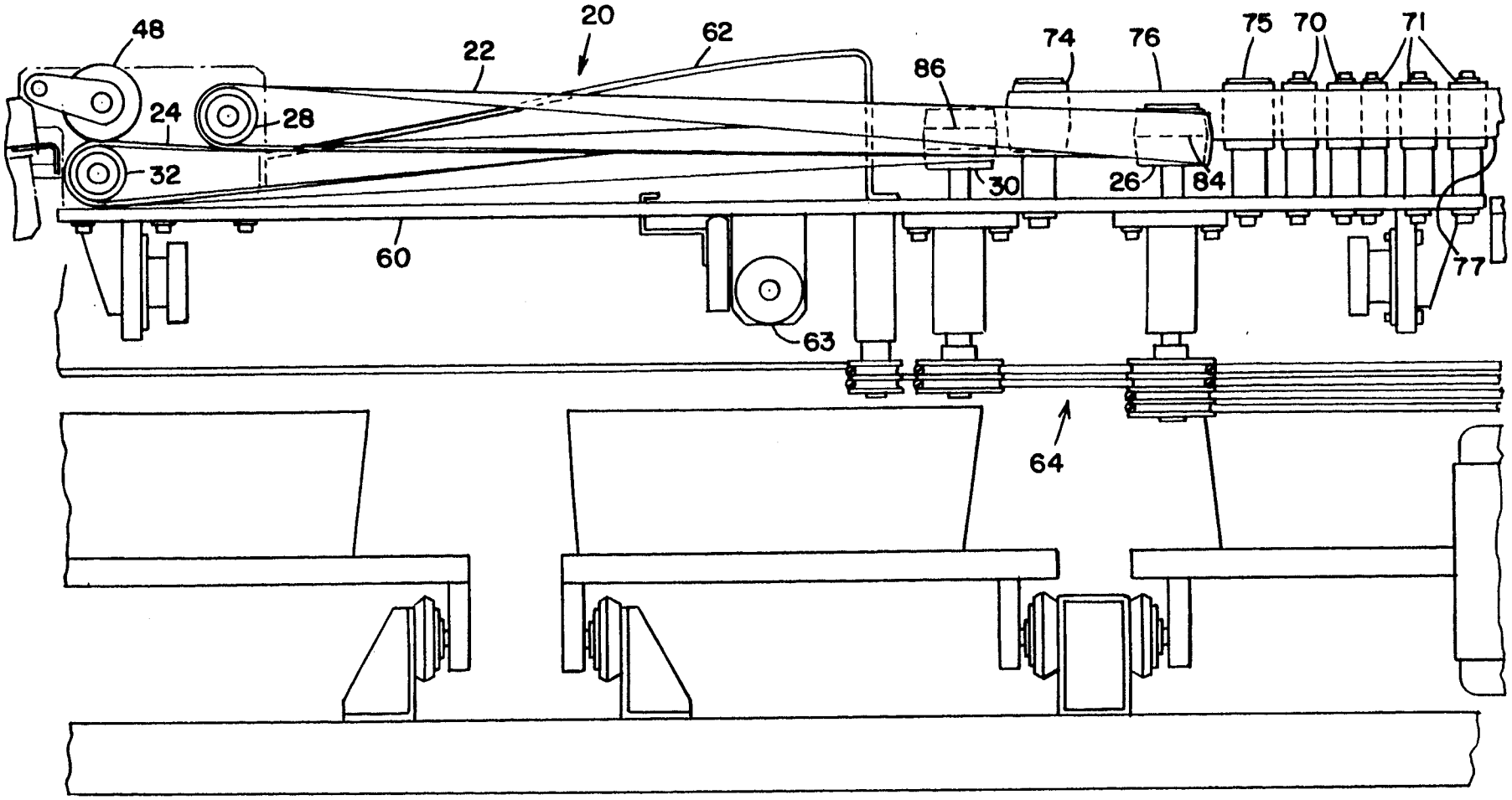
FIG. 6 is side view of the turn-up assembly of FIG. 3.

In describing the present invention, reference is made to the drawings, wherein there is seen in FIGS. 1–6 a turn-up device, generally designated 20, that can be utilized for turning flat articles, such as envelopes, 90 degrees from a horizontal orientation to a vertical orientation. Device 20 is located downstream from any mail processing system, such as an inserting machine (not shown), from which a stuffed envelope exits in a horizontal orientation, traveling on its long axis.

Upstream of turn-up device 20 is a conventional alignment transport 10 which provides top edge registration of envelope 5 before the envelope is conveyed to device 20. Transport 10 is representative of many inserter finishing modules which process mailpieces horizontally with the top edge of each mailpiece aligned to a constant position. Transport 10 is fixed in position and outputs each mailpiece in a horizontal orientation. Alignment transport 10 also serves as an interface between the upstream mail processing system (not shown) and turn-up device 20. The output drive (not shown) of transport 10 is a conventional passive resistance drive, such as a one way clutch bearing, which allows envelope 5 to be pulled out by the drive of turn-up device 20. In the preferred embodiment of the present invention, turn-up device 20 operates at a velocity greater than that of alignment transport 10.

Turn-up device 20 includes two elastic, flat belts 22 and 24. Belt 22, which is the upper belt at the entrance end of device 20, is stretched around drive pulley 26 and idler pulley 28. Belt 24 is the lower belt that is stretched around carefully located drive pulley 30 and idler pulley 32. Idler pulleys 28 and 32 are both longitudinally and vertically disposed. Drive pulleys 26 and 30 are both longitudinally and laterally disposed. At the entrance end of turn-up device 20 lower belt idler pulley 32 is secured to a shaft 42. Also secured to shaft 42 is a roller 40. Roller 40 is driven by shaft 42 which is driven by lower belt pulley 26 and belt 24. A plurality of idler rollers 46 are mounted above roller 40 and are pivotally biased against roller 40. Another biased idler roller 48 (shown only in FIGS. 5 and 6) is mounted above pulley 32. The surface speed of idler 40 is the same as the surface speed of belts 22 and 24.

Roller 40 and belts 22 and 24 are continually driven at a higher velocity, for example 120 in/sec, than upstream alignment transport 10 so as to pull the envelope 5 from the transport 10. Preferably, the belts and rollers of turn-up device 20 are driven by a single motor (not shown) and a conventional belt and pulley drive system (FIG. 6), generally designated 64. In this manner, belts 22 and 24 and roller 40 operate at same speed.

Turn-up device 20 is mounted to a large rectangular deck plate 60 which is laterally adjustable according to the depth of the envelopes 5 being processed. A conventional lead screw/slide adjustment mechanism 61 is coupled to the underside of deck plate 60 for adjusting the position of turn-up device 20. A handle 63 is coupled to adjustment mechanism 61 for turning mechanism 61. This provides adjustment for bottom edge registration of envelope at the exit of the turn-up device 20. When exiting alignment transport 10 envelope 5 is top edge aligned in a horizontal orientation. Turn-up device 20 is positioned so as to deliver a bottom edge alignment of envelope 5 as envelope 5 is turned 90 degrees to a vertical elastic flat belts orientation.

At the exit end of turn-up device 20 a pair of vertical belts 76 and 77 are stretched around idler pulleys 74 and 75 and drive pulleys 79 and 78 respectively. Extra groups of vertical, idler rollers 70, 71, 72 and 73 are rotatably mounted to deck plate 60 to provide smooth contour guides for exit belts 76 and 77 as turn-up device 20 is positioned for handling different sized envelopes. A more detailed description of the bottom edge alignment by positioning turn-up device 20 is disclosed in Application Serial No. [attorney docket E123] previously noted.

As mailpiece 5 is transported by belts 22 and 24, envelope 5 is in the control of the belts and thus follows the contour of belts 22 and 24. In this manner, mailpiece 5 goes from a horizontal orientation to a vertical orientation. A wire guide 62 acts as a plowing surface that assists in the turn-up of envelope 5. The contour of wire 62 follows twist of belts 22 and 24.

In conventional 90 degree turn-up devices a steering roller is strategically placed against each belt so as to prevent the belt from walking along the surface of the pulley and eventually sliding off the pulley when the belt moves through its 90 degree twisted contour. It has been found in the present invention that such use of steering rollers can be eliminated by longitudinally staggering the entrance and exit pulleys and providing the entrance, horizontal pulleys with offset crowns.

In accordance with the present invention, entrance pulleys 28 and 32 have offset crowns 80 and 82 respectively. Exit pulleys 26 and 30 have centerline crowns 84 and 86. Offset crowns 80 and 82 may be different, and are found by trial and error testing using the following criteria. First, all pulleys 26, 28, 30 and 32 are stationary in their respective rotational axis, i.e. the pulleys do not move in the y or z direction. Second, the entrance pulleys 28 and 32 and the exit pulleys 26 and 30 are longitudinally offset from each other respectively, i.e., the pulleys are offset in the x direction. This second criteria eliminates the need for any relative movement of the pulleys in handling envelopes having a variety of thicknesses. Third, the edges of belts 22 and 24 remain lined up with each other the entire 90 degree twist, i.e. the belts are not offset at any point during the turn-up movement. Fourth, exit pulleys 26 and 30 have centerline crowns. The foregoing criteria provide the needed equilibrium to maintain the belts on their respective pulleys without using steering rollers.

Once offset crowns 80 and 82 are separately determined for pulleys 28 and 32, belts 22 and 24 will track on their respective pulleys without the need for steering rollers. It has been found that once the offset crowns have been determined for pulleys 28 and 32, any movement of the pulleys in the y or z direction effects the tracking of belts 22 and 24 on their respective pulleys. However, movement of the pulleys in the x direction, i.e. the distance between the pulleys in x direction, does not effect the tacking of the belts. The combination of very specific pulley location and proper crowning of drive/idler pulleys has eliminated the need for the additional complexity and associated cost of steering rollers typically needed for turn-up devices.

The belt paths extend from horizontal, entrance pulleys 32 and 28 around vertical, drive pulleys 30 and 26. Each pair of entrance and exit pulleys is located in such a manner as to locate the belts directly on top of each other for the entire length of the 90 degree twist. Since pulleys 26, 28 ,30 and 32 are fixed in space, belt 22 and 24 stretch as envelope 5 is transported through the 90 degree turn-up. This aspect of the present invention provides a significant advantage over a conventional roller-to-roller nip which often generates a significant force pulse as flat articles, such as envelopes, are introduced. In the present invention the belt stretch produces the captivating force which transports the envelope along the length of the turn-up. This type of system eliminates the need for spring loaded idler arrangements that pivot and/or separate as envelopes having a variety of thicknesses are forced between two belts. By eliminating the need for such components the present invention comprises fewer parts, which, in turn, reduces complexity, and increases overall reliability.

As envelope 5 is transported beneath the stationary, upper, entrance pulley 28, lower belt 24 stretches and envelope 5 maintains its original horizontal orientation. The stretch of belt 24 creates the "nip" force as the envelope is accepted between the belts. As the envelope progresses past entrance pulley 28, it is influenced by the twisting contour of belts 22 and 24 and wire guide 62. By the time envelope 5 approaches exit pulleys 30 and 26, it has been manipulated to a substantially vertical orientation. (Exit pulleys 30 and 26 are longitudinally offset in such a manner as to exert the same "nip" force vertically as Entrance pulleys 32 and 28 do in the horizontal orientation.) There is a significant advantage in manipulating envelope 5 with the "soft nip" of elastic belts. The elastic belts form around and conform to the envelope even if the envelope is bulky or stiff without distorting the contents of the envelope.

While the present invention has been disclosed and described with reference to a single embodiment thereof, it will be apparent, as noted above that variations and modifications may be made therein. It is also noted that the present invention is independent of the machine being controlled, and is not limited to the control of inserting machines. It is, thus, intended in the following claims to cover each variation and modification that falls within the true spirit and scope of the present invention.

What is claimed is:

1. A device for turning flat articles, such as envelopes, from a horizontal orientation to a vertical orientation as the articles are transported along a path from an entrance location to an exit location, comprising:

a pair of entrance pulleys, each of said entrance pulleys having an offset crown and rotating on a stationary horizontal axis, said entrance pulleys located longitudinally and vertically apart from one another such that one of said entrance pulleys functions as lower entrance pulley and the other entrance pulley functions as an upper entrance pulley, said upper entrance pulley being located downstream from said lower entrance pulley a pair of exit pulleys, each of said exit pulleys having a centerline crown, said exit pulleys rotating on a stationary vertical axis, one of said exit pulleys located downstream from an upstream one of said exit pulleys first and second flexible, endless belts, said first belt being wrapped around said lower entrance pulley and said upstream exit pulley, and said second belt being wrapped around said upper entrance pulley and said downstream exit pulley, wherein said first and second belts complete a 90 degree twist from the respective entrance pulley to the respective exit pulley such that said first and second belts each have a contiguous span for approximately the entire 90 degree twist against which a corresponding span of the other belt applies a normal force.

2. The device of claim 1 further comprising means for driving said exit pulleys to move said first and second belts in the same direction and at the same velocity for transporting the articles from the entrance location to the exit location.

3. The device of claim 1 further comprising means for guiding flat articles that are transported by the belts through the ninety degree twist.

4. The device of claim 3 wherein said guiding means comprises a contour wire guide shaped to guide a portion of the flat article that is extending beyond the grip of the first and second belts.

5. The device of claim 1, further comprising a lower entrance roller adjacent said lower entrance pulley and rotating on the same horizontal axis as said lower pulley.

6. The device of claim 5 further comprising a plurality of idler rollers against said lower entrance roller and said lower idler pulley.

* * * * *